US012090419B2

(12) United States Patent
Donaldson et al.

(10) Patent No.: US 12,090,419 B2
(45) Date of Patent: Sep. 17, 2024

(54) MODULAR TOY SYSTEM WITH ELECTRONIC TOY MODULES

(71) Applicant: LEGO A/S, Billund (DK)

(72) Inventors: Thomas Alan Donaldson, Billund (DK); Mark Ross Champkins, Billund (DK); Silviu Toma, Cambridgeshire (GB); Robert George Milner, Cambridgeshire (GB); Simon Mark Jordan, Upper Cambourne (GB); Simon John Turner, Cambridge (GB); Mark Craig Brannan, Cambridgeshire (GB); Martin Edward Brock, Cambridge (GB)

(73) Assignee: LEGO A/S, Billund (DK)

( * ) Notice: Subject to any disclaimer, the term of this patent is extended or adjusted under 35 U.S.C. 154(b) by 283 days.

(21) Appl. No.: 17/427,596

(22) PCT Filed: Dec. 12, 2019

(86) PCT No.: PCT/EP2019/084779
§ 371 (c)(1),
(2) Date: Jul. 30, 2021

(87) PCT Pub. No.: WO2020/156719
PCT Pub. Date: Aug. 6, 2020

(65) Prior Publication Data

US 2022/0118375 A1 Apr. 21, 2022

(30) Foreign Application Priority Data

Jan. 31, 2019 (DK) ..... 201970072

(51) Int. Cl.
*A63H 33/00* (2006.01)
*A63H 17/00* (2006.01)
(Continued)

(52) U.S. Cl.
CPC ..... *A63H 33/042* (2013.01); *A63H 29/22* (2013.01); *A63H 33/26* (2013.01); *A63H 17/002* (2013.01);
(Continued)

(58) Field of Classification Search
CPC .... A63H 33/042; A63H 17/002; A63H 33/26; A63H 2200/00
See application file for complete search history.

(56) References Cited

U.S. PATENT DOCUMENTS 5,823,782 A * 10/1998 Marcus ..... G09B 7/04 434/335
6,159,101 A * 12/2000 Simpson ..... A63H 3/46 463/36
(Continued)

FOREIGN PATENT DOCUMENTS

AU 2014273979 A1 * 12/2015 ..... A63F 13/00
CN 107531296 A 1/2018
(Continued)

OTHER PUBLICATIONS

First Technical Examination and Search Report from corresponding Danish patent application No. PA201970072, mailed Aug. 28, 2019, 7 pages.
(Continued)

*Primary Examiner* — Steven J Hylinski
(74) *Attorney, Agent, or Firm* — Day Pitney LLP; George Chaclas; Anthony A. Kassas

(57) ABSTRACT

A modular toy system comprising a plurality of separate electronic toy modules, each electronic toy module comprising a function device operable to perform a user-perceptible function and a control circuit for controlling the function device; wherein at least a first electronic toy module of the plurality of electronic toy modules comprises a first
(Continued)

control circuit, a first function device and a sensor system configured for contactless detection of respective coordinate values of at least two coordinates, each coordinate being indicative of a position or an orientation of at least a second electronic toy module of the plurality of electronic toy modules relative to the first electronic toy module; and wherein the first control circuit is configured to control operation of the first function device based on one or more of the detected coordinate values.

17 Claims, 5 Drawing Sheets

(51) Int. Cl.

| | |
|---|---|
| ***A63H 29/22*** | (2006.01) |
| ***A63H 33/04*** | (2006.01) |
| ***A63H 33/26*** | (2006.01) |
| *A63H 17/36* | (2006.01) |
| *A63H 30/04* | (2006.01) |
| *A63H 33/08* | (2006.01) |

(52) U.S. Cl.
CPC ..... *A63H 17/36* (2013.01); *A63H 30/04* (2013.01); *A63H 33/086* (2013.01); *A63H 2200/00* (2013.01)

(56) References Cited

U.S. PATENT DOCUMENTS

| | | | | |
|---|---|---|---|---|
| 6,834,251 | B1 * | 12/2004 | Fletcher | G01V 15/00 314/5 |
| 7,371,177 | B2 * | 5/2008 | Ellis | A63F 13/52 446/175 |
| D585,036 | S * | 1/2009 | Riggs | D14/126 |
| 8,057,233 | B2 * | 11/2011 | Owen | G09B 1/36 434/167 |
| 8,398,470 | B2 * | 3/2013 | Gillies | A63F 9/0842 463/31 |
| 8,439,757 | B2 * | 5/2013 | Hornsby | A63H 11/00 463/31 |
| 9,128,661 | B2 * | 9/2015 | Zilber | A63F 13/22 |
| 10,195,538 | B2 * | 2/2019 | Madsen | A63H 33/04 |
| 10,610,773 | B2 * | 4/2020 | Bellingham | A63F 13/285 |
| 11,498,014 | B1 * | 11/2022 | Aalund | A63H 33/26 |
| 11,541,322 | B1 * | 1/2023 | Aalund | G09B 1/325 |
| 2007/0015588 | A1 * | 1/2007 | Matsumoto | A63F 13/214 463/43 |
| 2009/0273560 | A1 * | 11/2009 | Kalanithi | G06F 3/038 345/156 |
| 2009/0305602 | A1 | 12/2009 | Gaute | |
| 2012/0258436 | A1 * | 10/2012 | Lee | G09B 19/003 434/362 |
| 2013/0217295 | A1 * | 8/2013 | Karunaratne | A63H 30/04 446/124 |
| 2014/0030955 | A1 * | 1/2014 | Smetanin | A63H 3/36 446/268 |
| 2015/0258435 | A1 * | 9/2015 | Zhang | A63F 13/235 463/36 |
| 2016/0361662 | A1 | 12/2016 | Karunaratne | |
| 2017/0144083 | A1 | 5/2017 | Kærsgaard et al. | |
| 2017/0157768 | A1 | 6/2017 | Buthala et al. | |
| 2017/0252664 | A1 * | 9/2017 | Cletheroe | A63H 33/046 |
| 2018/0071626 | A1 | 3/2018 | Pedersen et al. | |

FOREIGN PATENT DOCUMENTS

| | | | | |
|---|---|---|---|---|
| EP | 3075425 | A1 | 10/2016 | |
| GB | 2564715 | A * | 1/2019 | A63F 13/655 |
| WO | 2002/095517 | A1 | 11/2002 | |
| WO | WO-2010150232 | A1 * | 12/2010 | A63H 33/042 |
| WO | WO-2015173246 | A1 * | 11/2015 | A63H 33/042 |
| WO | WO-2016099260 | A1 * | 6/2016 | A63H 33/042 |
| WO | WO-2017130004 | A1 * | 8/2017 | A63H 33/042 |
| WO | 2018/158357 | A2 | 9/2018 | |
| WO | WO-2019121629 | A1 * | 6/2019 | A63F 13/21 |
| WO | WO-2020156719 | A1 * | 8/2020 | A63H 17/002 |
| WO | WO-2020156720 | A1 * | 8/2020 | A63H 30/00 |
| WO | WO-2020156721 | A1 * | 8/2020 | A63H 33/04 |

OTHER PUBLICATIONS

International Search Report and Written Opinion issued in corresponding international patent application PCT/EP2019/084779, mailed Apr. 7, 2020, 9 pages.

First Office Action issued in corresponding Chinese Patent Application No. 201980090887.9, mailed May 7, 2022, 6 pages (English translation only).

* cited by examiner

MODULAR TOY SYSTEM WITH ELECTRONIC TOY MODULES

CROSS-REFERENCE TO RELATED APPLICATIONS

This application is a U.S. National Stage of International Application No. PCT/EP2019/084779, filed on 12 Dec. 2019 and published on 6 Aug. 2020, as WO2020/156719, which claims the benefit of priority to Danish Patent Application No. PA 2019 70072, filed on 31 Jan. 2019. The content of each of the above referenced patent applications is incorporated herein by reference in its entirety for any purpose whatsoever.

TECHNICAL FIELD

The present disclosure relates to a modular toy system comprising a plurality of electronic toy modules.

BACKGROUND

Various modular toy systems that include electronic toy modules are known in the art. One type of modular toy system includes modular toy construction systems including electronic toy construction elements.

Toy construction systems have been known for decades. Over the years, simple box-shaped building blocks have been supplemented with toy construction elements that have a specific appearance or a mechanical or electrical function to enhance the play value of the system. Such functions include e.g. motors, switches, and lamps, but also programmable processors that accept input from sensors and can activate function elements in response to received sensor inputs.

Self-contained function construction elements exist which have a function device adapted to perform a preconfigured function, an energy source for providing energy to the function device for performing the function, and a trigger responsive to an external trigger event to trigger the function device to perform the function. Typically, such known function construction elements are designed for manual activation of a mechanical trigger and only provide a limited play value.

WO 2007/137577 discloses a toy construction system comprising function elements and control elements. The function and control elements are electrically interconnectable via a system of wires and plugs, such that the function elements receive both electrical power and control signals from the control elements. Even though this system avoids the need for electrical energy storage in the function elements, it requires a certain level of abstract thinking and technical insight in order to correctly set up the wiring and to interconnect the construction elements so as to construct functional toy models from such a system. Moreover, the wires between the various elements limit the freedom to freely construct toy construction models and may affect the visual appearance of the models.

WO 2015/173246 discloses a toy construction system comprising a plurality of interactive toy construction elements each comprising coupling members configured for releasably interconnecting the interactive toy construction elements with each other. The system comprises function construction elements and input construction elements. Each input construction element comprises a wireless transmitter for transmitting a control signal to at least a subset of the function construction elements. Each function construction element comprises: a function device adapted to perform a controllable function; a wireless receiver for receiving the wireless control signal; and a control circuit connected to the wireless receiver and to the function device and adapted to control the controllable function responsive to the received control signal. Each interactive toy construction element comprises a user-operable selector allowing a user to select one of a predetermined set of group identifiers. The interactive toy construction elements further comprise a group indicator being configured to output an indication indicative of the selected group identifier.

Nevertheless, it remains desirable to provide a modular toy system where the user can assemble multiple toy modules and where the resulting behaviour of the assembly can be determined and/or controlled in a user-friendly manner. In particular, it is desirable that configuring the resulting assembly does not require a high level of abstract thinking and technical insight in order to correctly set up the assembly so as to arrive at an assembly with an interesting functional behaviour.

It is generally desirable to provide a modular toy system that provides enhanced educational activities and/or play activities.

It is further desirable to provide a modular toy system that provides a high degree of flexibility in designing different toy assemblies with a rich functionality.

Moreover it is desirable to provide a modular toy system that allows users, in particular children, to construct multiple interactive toy assemblies in a user-friendly, efficient, yet flexible and reliable manner without the need for a detailed knowledge of control structures, data communication, and how to properly connect electrical wires, conductors, etc.

Various aspects of embodiments of a modular toy system disclosed herein address one or more of the above needs and/or other needs that exist in the field of toy systems.

SUMMARY

Disclosed herein are aspects of a modular toy system. According to one aspect, the modular toy system comprises a plurality of separate electronic toy modules, each electronic toy module comprising a function device operable to perform a user-perceptible function and a control circuit for controlling the function device; wherein at least a first electronic toy module of the plurality of electronic toy modules comprises a first control circuit, a first function device and a sensor system configured for contactless detection of respective coordinate values of at least two coordinates, each coordinate being indicative of a position or an orientation of at least a second electronic toy module of the plurality of electronic toy modules relative to the first electronic toy module; and wherein the first control circuit is configured to control operation of the first function device based on one or more of the detected coordinate values.

Accordingly, as at least the first function device is controlled based on a detection of two or more position and/or orientation coordinates, an interesting behaviour of an assembly of multiple electronic toy modules may be achieved, simply by arranging the electronic toy modules relative to one another and without the need to provide mechanical or electrical connection between the modules or to configure a communications interface. Preferably, more than one, such as each, of the plurality of electronic toy modules includes a sensor system as described herein and controls its function device based on detected coordinate values indicative of a relative position and/or orientation of one or more other electronic toy modules of the plurality of electronic toy modules. In the following, a number of features of embodiments of the first electronic toy module will be described. It will be appreciated that, in embodiments where more than one electronic toy module includes a sensor system as described herein, some, in particular each, of these electronic toy modules may include some or all of the features described with reference to the first electronic toy module.

Here the term contactless is intended to refer to measurements that do not rely on, or otherwise require mechanical or even conductive coupling, in particular measurements that do not rely on transfer of electrical or other energy by means of physical contact, e.g. via a conductive medium that is conductive for a direct current. It will be appreciated that the term contactless merely characterises the measurement process and does not exclude that the first and second electronic toy modules may otherwise be physically connected with each other. In particular two toy modules may be in physical contact with each other, e.g. mechanically interconnected with each other by means of respective coupling members, while the detection of the relative position and orientation coordinates is contactless, i.e. does not rely on the physical contact as a carrier for energy, forces, information, or the like. The first electronic toy module may be operable to detect the coordinate values of electronic toy modules positioned in a detection range of the sensor system. The detection range may be at least 10 cm, such as at least 20 cm, such as at least 30 cm. Here and in the following, reference to detection ranges refers to detection ranges under normal operational conditions and in normal operational environment, e.g. inside a child's room.

The detection of the coordinate values may include detection of the presence of another electronic toy module, in particular of the second electronic toy module. The detection may include detection of more than one, such as all, electronic toy modules within a detection range of the sensor system and of coordinate values of coordinates indicative of respective positions and/or orientations of said more than one electronic toy modules.

The detection may be based on any suitable detection mechanism suitable for measuring distances and/or orientations. To this end, the sensor system may include one or more sensors. When more than one sensor is employed, the sensors may be based on the same or on different detection technologies. Preferably, the detection mechanism is independent of a line-of-sight visibility of the second electronic toy module from the first electronic toy module, i.e. allows detection of coordinate values of the second electronic toy module even when other objects, such as other toy modules of the system are positioned between the first and the second electronic toy modules.

In some embodiments, the sensor system is configured to detect one or more position coordinates and one or more orientation coordinates, such as a single position coordinate and two or three orientation coordinates, or two or more position coordinates and a single orientation coordinate or more orientation coordinates. In some embodiments, the sensor system is configured to only determine two or three position coordinates and no orientation coordinates. In other embodiments, the sensor system is configured to only determine two or three orientation coordinates and no position coordinates.

In some embodiments, the determination of the coordinates does not rely on a data communication occurring between the first and second electronic toy modules. It will be appreciated, however, that communication between the first and second electronic toy module may indeed take place. In some embodiments, the first and second electronic toy modules may even communicate data for use in the determination of the coordinates. This may reduce the requirements on the sensor system, e.g. allowing the determination to be based on fewer sensors. For example, the second electronic toy module may communicate data to the first electronic toy module and the first electronic toy module may use the communicated data in the determination of the coordinates. The communicated data may include information indicative of a strength of an excited magnetic field by one or more coils of the second electronic toy module. Alternatively or additionally, the communicated data may include information about a measured strength of a geomagnetic field measured by the second electronic toy module, e.g. along an internal reference direction of the second electronic toy module.

In many situations, it is desirable to provide toy modules that are compact and/or relatively inexpensive to manufacture. Accordingly, it may be desirable to keep the number of sensors small, e.g. limited to two or three sensors.

It has turned out that, in some embodiments, three sensors are sufficient to determine four independent coordinates, such as a position coordinate and three orientation coordinates.

The detection of coordinate values results in a measured value of said coordinate value. The measured value preferably has a sufficient resolution, in particular higher than a binary resolution, so as to be able to distinguish between grades of positions. The resolution is preferably 4 bits or better, such as 7 bits or better.

In some embodiments, the detection is at least in part based on a measurement of an electric field, a magnetic field and/or of an electromagnetic field generated by the second electronic toy module or otherwise influenced by the second electronic toy module. To this end, the sensor system may comprise one or more electromagnetic coils and/or one or more magnetometers.

When the sensor system comprises one or more electromagnetic coils, the coils may further be utilised for contactless energy harvesting and/or for contactless communication. Accordingly, one or more of the electromagnetic coils may be configured for contactless, e.g. inductive, energy harvesting. In some embodiments, the electromagnetic coils may be operable to harvest energy from an electromagnetic field, e.g. from an RF communications signal.

The harvested energy may be used for operating one or more of the function devices, e.g. by directly feeding the harvested energy to the function device or by charging an energy storage device, e.g. a rechargeable battery.

In some embodiments the first electronic toy module comprises a single housing, and the first function device, the first control circuit and the sensor system are all accommodated within the same housing. In other embodiments, the first electronic toy element is itself modular, i.e. made up of two or more interconnected or interconnectable elements. For example, one element may include the function device while another element includes the sensor system. The control circuit may be included in one of the elements, it may be distributed between both elements or it may be provided in a separate toy element. For example, in one embodiment, the function device is accommodated within a separate function toy element that may be operationally coupled to a control toy element that controls the function device and/or supplies operating power to the function device. To this end, the control toy element may be mechanically interconnected to the function toy element. Alternatively or additionally, the electronic toy element may be coupled to the function toy element by an electric, inductive and/or capacitive coupling. Preferably, the coupling members for interconnection between the control and function toy elements enforce one or a limited number of possible relative orientations.

In some embodiments, at least one, such as each, of the electronic toy modules is a passive electronic toy module, i.e. an electronic toy module that does not comprise its own battery or other energy storage. Instead, the passive electronic toy construction module uses, at its sole power supply, energy that is contactless received via the one or more electromagnetic coils. The passive electronic toy module is thus only operable to control a function device while the passive electronic toy construction module is coupled for contactless receipt of energy from an energy supplying component, e.g. from another toy module. In alternative embodiments, at least one, such as each, of the electronic toy modules includes its own energy storage device, e.g. its own battery or other energy storage, in particular for providing a function device of the electronic toy module with operating power. The battery or other energy storage may be recharged by means of the harvested energy and/or in a different wireless or wired manner.

In one embodiment, the sensor system comprises at least two electromagnetic coils, such as exactly two coils or three coils. The coils may be configured to sense a time-varying magnetic field. Each coil may define a coil axis and the coils may be arranged such that their respective coil axes are not parallel to each other, i.e. define an angle larger than zero between each other, e.g. a right angle. For example, the smallest angle defined between the coil axes may be between 20° and 90°, such as between 45° and 90°, such as between 80° and 90°, preferably 90°. Accordingly the detection of the coordinates is less sensitive to the relative orientation of the first and second electronic toy module relative to each other.

In some embodiments, the sensor system includes two or three electromagnetic coils, e.g. with their respective coil axes not parallel to each other, e.g. at right angles relative to each other.

Alternatively or additionally to one or more electromagnetic coils, the sensor system may comprise one or more magnetometers, such as one or more vector magnetometers, e.g. one or more magneto-resistive magnetometers, one or more Hall Effect magnetometers, and/or the like. The magnetometer may be configured to measure a static magnetic field. The magnetometer may be provided as an on-chip device, such as a device integrated into a control chip of the first electronic toy module that may also include the control circuit. The control chip may thus comprise a processor and/or other control circuitry for controlling the operation of the function device, of the sensor system etc. The magnetometer may be aligned with a plane defined by the chip. The magnetometer may be a single plane sensor, e.g. a single plane Hall sensor, or other sensor that is configured to measure an external magnetic field, in particular a static magnetic field, along a single direction.

In some embodiments, the sensor system of the first electronic toy module includes two electromagnetic coils and a magnetometer, in particular a magnetometer configured to sense a component of the geomagnetic field along a single direction. In particular, the sensor system may consist of two electromagnetic coils and a single magnetometer, in particular a magnetometer configured to sense a component of the geomagnetic field along a single direction. It has turned out that this embodiment is particularly cost-efficient to manufacture and allows for a very compact design.

In some embodiments, the sensor system is further configured to detect an orientation of the first electronic toy module relative to a geomagnetic field. In particular, to this end, the sensor system may comprise a magnetometer as described above and in the following. Accordingly, the sensor system may determine at least an estimate of an absolute orientation of the first electronic device relative to an external reference.

In some embodiments, the second electronic toy module also comprises a sensor system configured for contactless detection of respective coordinate values of at least two coordinates, each coordinate being indicative of a position or an orientation of at least the first electronic toy module relative to the second electronic toy module. Accordingly the first and second electronic toy modules are operable to detect coordinate values of their respective positions and/or orientations, i.e. to perform a mutual position and/or orientation detection. Embodiments of the sensor system of the second electronic toy module may be as described in respect of the sensor system of the first electronic toy module. In particular, the first and second electronic toy modules may include the same type of sensor system, in particular using the same number, types and arrangement of sensors. In some embodiments, each of the plurality of electronic toy modules includes such a sensor system, e.g. so as to allow them to detect each other's coordinate values when operated within each other's detection range.

In some embodiments the two coordinates comprise a distance between the second electronic toy module and the first electronic toy module and/or another suitable position coordinate, e.g. a distance to a common reference point. In some embodiments, the sensor system is configured to detect a single position coordinate of the second electronic toy module, e.g. the distance between the second electronic toy module and the first electronic toy module. In other embodiments, the sensor system is configured to detect two or even three position coordinates of the second electronic toy module, e.g. relative to a local coordinate system of the first electronic toy module.

In some embodiments the two coordinates comprise an orientation coordinate between the second electronic toy module and the first electronic toy module and/or relative to a common reference orientation. The orientation coordinate may be indicative of an angle relative to reference direction. In some embodiments, the sensor system is configured to detect a single orientation coordinate of the second electronic toy module. In other embodiments, the sensor system is configured to detect two or, preferably, even three orientation coordinates of the second electronic toy module, e.g. relative to a local coordinate system of the first electronic toy module. The orientation coordinates may reflect angles relative to respective reference directions, e.g. respective mutually orthogonal reference directions or reference directions of another suitable coordinate system. The three orientation coordinates may e.g. reflect a pitch, a yaw and a roll angles, respectively.

In one embodiment, the sensor system is configured to detect a single position coordinate, e.g. the distance between the second and the first electronic toy modules, and three orientation coordinates.

The electronic toy modules are separate modules that can be moved about individually and independently from each other. Nevertheless, in some embodiments, the electronic toy modules are mechanically interconnectable with each other and/or with other toy modules of the system so as to form a coherent toy assembly. In particular, in some embodiments, the modular toy system is a modular toy construction system including a plurality of toy construction elements for constructing coherent spatial structures, also referred to as toy construction models. Each electronic toy module may thus include one or more electronic toy construction elements. For example the first electronic toy module may be formed as a single electronic toy construction element compatible with the toy construction system. Alternatively, the first electronic toy module may be formed as an assembly of two or more interconnected electronic toy construction elements.

Modular toy construction systems often allow a large variety of different toy construction models to be constructed from a limited number of different types of toy construction elements, each toy construction model having a different physical configuration as defined by the spatial arrangement of the toy construction elements within the toy construction model. Generally, the term toy construction element refers to the smallest elements of the toy construction system that cannot be disassembled into smaller elements during normal use and, in particular, a toy construction element can, during normal use, normally not be disassembled per se in a non-destructive manner and/or without the use of tools. Here the term "normal use" is intended not to include maintenance operations such as replacement of batteries.

Some or all of the toy construction elements may be electronic toy construction elements which include a sensor system as described herein and/or a function device and/or a control circuit as described herein. In some embodiments, only some of the toy construction elements are electronic toy construction elements that include a function device, sensor system and/or control circuit. Accordingly, in some embodiments, the toy construction system further comprises a plurality of other toy construction elements, in particular, non-electronic toy construction elements, such as conventional toy construction elements, e.g. toy construction elements consisting of a moulded plastic element or an element made in a different manner and/or from another suitable material such as wood, without any electronic components. In some embodiments the toy construction system comprises different types of electronic toy construction elements, e.g. including different types of function devices, with or without a sensor system as described herein, etc.

Each toy construction element of the toy construction system and, in particular, each electronic toy module formed from one or more electronic toy construction elements, may comprise coupling members configured to engage coupling members of other toy construction elements of the toy construction system so as to detachably attach the toy construction elements to each other. To this end, the coupling members may utilize different coupling mechanisms, e.g. based on frictional engagement of the coupling members with each other, based on screws, plug-and-socket connections or other forms of mating engagements of cooperating coupling members.

Hence, toy construction elements that have been interconnected with each other by means of the coupling members can again be disconnected from each other such that they can be interconnected again with each other or with other toy construction elements of the system, e.g. so as to form a different spatial structure. In some embodiments, the toy construction elements are provided with a first and a second type of coupling members, such as coupling pegs and peg-receiving recesses for frictionally engaging the pegs, or other pairs of mating or otherwise complementary coupling members configured to engage each other so as to form a physical connection. One type of coupling members may be located on one side, e.g. the top side, of the toy construction element while another, complementary type of coupling members may be located on an opposite side, e.g. the bottom side, of the toy construction element. In some embodiments, the toy construction elements include pegs extending from the top face of the toy construction element and corresponding peg-receiving cavities extending into the bottom face of the toy construction element for frictionally engaging the pegs by a suitable clamping force.

Generally, the toy construction system may impose limitations on the degrees of freedom of how the toy construction elements may be attached to each other, e.g. by limiting the possible relative positions and/or orientations at which they can be attached to each other. These limitations facilitate the detection of relative positions and/or orientations of electronic toy construction elements within a toy construction model.

To this end, the coupling members may be positioned on grid points of a regular grid; in particular, the coupling members of the toy construction elements may be arranged such that the coupling members of a set of mutually interconnected toy construction elements are positioned on grid points of a three-dimensional regular grid. The dimensions of the toy construction elements may be defined as integer multiples of a unit length defined by the regular grid. It will be understood that a three-dimensional grid may be defined by a single unit length, by two unit lengths, e.g. one unit length applicable in two spatial dimensions while the other unit length is applicable in the third spatial dimension. Yet alternatively, the three-dimensional grid may define three unit lengths, one for each spatial dimension.

In some embodiments, the toy construction elements are made from plastics material, e.g. thermoplastic polymers, or from another suitable material. The toy construction elements may e.g. be made by an injection molding process or by another suitable manufacturing process.

Each electronic toy construction element may comprise a housing. A function device and/or the sensor system and/or the control circuit are accommodated within said housing. The housing may be box-shaped. The housing may define a top face and a bottom face, opposite the top face. At least some of the coupling members may extend from the top face. The housing may further comprise one or more side faces extending between the top and bottom faces. In some embodiments all electronic toy construction elements are configured to be interchangeably and detachably connectable to other toy construction elements of the toy construction system.

Embodiments of the modular toy construction system described herein provide a distributed control system where function devices and sensors are provided in electronic toy construction elements. Control of the function devices is performed by control circuits integrated into some or all of the electronic toy construction elements and/or into separate control toy construction elements. The compactness and modularity further increases the flexibility in which the electronic toy construction elements can be incorporated into even relatively small toy construction models. In some embodiments, the housing of an electronic toy construction element has a height (excluding the protruding coupling members) of between 3 mm and 10 mm, such as between 3.2 mm and 9.6 mm, such as 3.2 mm or 6.4 mm or 9.6 mm. The length and width of the housing may each be between 5 mm and 35 mm, such as between 8 mm and 32 mm, such as 8 mm, 16 mm, 24 mm or 32 mm. For example the lateral dimensions may be 16 mm×16 mm or 16 mm×24 mm or 16 mm×32 mm. It will be appreciated, however, that other dimensions may be selected.

In some embodiments where the electronic toy modules are each formed as one or more electronic toy construction elements, the sensor system of the first electronic toy module may detect the coordinate values indicative of respective coordinates of the second electronic toy module irrespective of whether the first and second electronic toy modules are directly or indirectly interconnected with each other. In particular, the sensor system of the first electronic toy module may detect the coordinate values indicative of respective coordinates of the second electronic toy module when the first and second electronic toy modules are parts of different, separate toy construction models that may be freely moved about relative to each other. Similarly, the sensor system of the first electronic toy module may detect the coordinate values indicative of respective coordinates of the second electronic toy module when the first and second electronic toy modules are parts of the same toy construction model but separated from each other by other non-electronic toy construction elements and, in particular by toy construction elements without sensor system. In such systems, it may be desirable for the first electronic toy module to determine whether or not the first and second electronic toy modules are part of the same toy construction model or not. To this end the first electronic toy module may determine whether the measured distance and/or orientation relative to the second electronic toy module is consistent with limitations imposed by the toy construction system, in particular consistent with limitations imposed on the possible relative distances and/or orientations of mutually interconnected toy construction elements. Alternatively or additionally, the first electronic toy module may monitor the relative distance and/or relative orientation over a period of time. If the distance and/or relative orientation remain constant, e.g. over the predetermined period of time, the first electronic toy module may determine that the first and second electronic toy module are indeed interconnected. It will be appreciated that the first electronic toy module may alternatively or additionally determine a time derivative of the distance and/or relative orientation in a suitable manner in order to make the determination as to whether the toy modules are likely interconnected with each other. When the first electronic toy module further comprises an accelerometer or other movement sensor, and if the distance and/or relative orientation remain constant while the accelerometer or other movement sensor detects a movement of the first electronic toy module, the first electronic toy module may determine that the first and second electronic toy module are indeed interconnected. Yet similarly, the first electronic toy module may be able to detect its own orientation relative to a global magnetic field or other global reference direction or coordinate system, e.g. by means of a magnetometer. When the distance and/or relative orientation remain constant while the first electronic toy module detects a change of its own position and/or orientation relative to a global coordinate system, the first electronic toy module may determine that the first and second electronic toy module are indeed interconnected.

To this end, in some embodiments where the electronic toy modules are mechanically interconnectable with each other so as to form a toy assembly, the sensor system is configured to monitor a coordinate value (or otherwise determine a time derivative) of at least one of the coordinates; and wherein the modular toy system comprises a processor configured to determine, based on the monitored coordinate value and, optionally based on one or more further sensor signals, whether or not the first and second electronic toy modules are mechanically interconnected. For example, the processor may control operation of one or more of the function devices in dependence of the determination as to whether the electronic toy modules are mechanically connected to other electronic toy modules. The processor may be implemented completely or in part by the first control circuit of the first electronic toy module, by a control circuit of another one of the electronic toy modules, by a separate processing unit and/or the like.

In some embodiments, the first electronic toy module may be configured to detect a type of the second electronic toy module, e.g. based on communicated data between the first and second electronic toy module. In some embodiments, the first electronic toy module may be configured to receive communicated data from the second electronic toy module indicative of one or more sensor values, e.g. of a sensed strength of a geomagnetic field, and/or of one or more operational parameters, e.g. an excitation strength of one or more coils of the second electronic toy module. To this end the first and second electronic toy modules may each include a suitable communications interface, e.g. as described in more detail below. The function device of the first electronic toy module may be controlled responsive to which other electronic toy module(s) the first electronic toy module is mechanically interconnected with and, optionally, responsive to the spatial configuration (e.g. relative distance(s) and/or orientation(s)) of the mechanically interconnected electronic toy modules. The spatial configuration will also be referred to as the physical topology of an assembly of mechanically interconnected toy modules.

It will be appreciated that the mechanical interconnection between two electronic toy modules may be a direct interconnection where the electronic toy modules directly touch each other, or an indirect interconnection where the electronic toy modules are interconnected via one or more other toy modules. In particular electronic toy modules in the form of electronic toy construction elements may be directly or indirectly interconnected with each other and, optionally with other toy construction elements of the toy construction system, so as to form a toy construction model.

Monitoring a coordinate value generally includes detecting changes and/or a time derivative of the monitored coordinate value, i.e. changes in the position and/or orientation of the second electronic toy module relative to the first electronic toy module.

The processor configured to determine, based on the monitored coordinate value, whether or not the first and second electronic toy modules are mechanically interconnected may be integrated into first electronic toy module or it may be provided externally to the first electronic toy module. In the latter case, the first electronic toy module may comprise a communications interface for communicating data with the external processor, e.g. as described in greater detail below. The processor may be a suitably programmed microprocessor or another suitable form of processing device.

In some embodiments, the first electronic toy module may include a communications interface for data communication with the second electronic toy module and/or with one or more other electronic toy modules of the plurality of electronic toy modules of the modular toy system and/or with an external processing device such as a computer, a tablet computer, a smart phone, etc. In some embodiments, the second electronic toy modules and/or one or more or even all of the other electronic toy modules also include respective communication interfaces.

The communications interface may be wired or wireless. In particular, the communications interface may be operable for short-range, wireless communications, e.g. short-range RF communication, e.g. in the 2.4 GHz frequency band or another suitable frequency band, e.g. via Bluetooth, Wifi or a similar suitable short-range communications technology. In some embodiments, the communications interface may utilize electromagnetic coils of the first and second electronic toy modules, e.g. by means of an inductive coupling between the coils. Alternatively, the communications interface may utilise a separate antenna.

Here the term short-range communications is intended to refer to a communications technology having a communications range of no more than 100 m, such as no more than 10 m, such as no more than 5 m, such as no more than 2 m. In most situations, a communications range of less than 10 m and, in most cases even less than 5 m is sufficient, even though in some embodiments longer ranges may be acceptable or even desirable. In some embodiments, the communications range is larger than 1 cm larger than 10 cm, such as larger than 50 cm, such as larger than 1 m.

A function device may be any suitable device for performing a function, such as a function that provides a user-perceptible effect, such as a visible and/or audible effect. Examples of function devices may include any suitable mechanical and/or electrical device, arrangement, and/or circuitry adapted to perform one or more mechanical and/or electrical functions.

Examples of a mechanical function that some embodiments of the function device described herein can perform include driving a rotatable output shaft, winding-up a string or a chain which enables pulling an object closer to a toy module, moving a hinged part of the electronic toy module, etc. The mechanical function may thus enable opening or closing a door, ejecting an object, rotating a turntable, moving a linear actuator, etc. Such mechanical motions can be driven by an electric motor.

Examples of an electrical function that some embodiments of the function device described herein can perform include emitting constant or blinking light, activating several lamps in a predetermined sequence, emitting audible sound such as beep, alarm, bell, siren, voice message, music, synthetic sound, natural or imitated sound simulating and/or stimulating play activities, playback of a sound, and/or other audio content, etc.

Accordingly, the function device may be selected from a motor, a light source (e.g. one or more LEDs) and a sound source (e.g. a loudspeaker). In some embodiments, the plurality of electronic toy modules includes different electronic toy modules comprising respective, different types of function devices.

In some embodiments, one or more of the electronic toy modules includes one or more additional sensors, e.g. a linear or rotary encoder, a light detector and a sound detector (e.g. a microphone), etc.

Generally, in some embodiments, each electronic toy module may include a single function device. Hence, the functionality of each electronic toy module is easy to understand by the user and may be combined in a modular fashion.

The electronic toy modules may be manufactured with a default behaviour, e.g. with default executable instruction stored in a memory of the electronic toy module and executable by a processing unit of the electronic toy module. The default executable instructions may define a set of predetermined rules for creating control signals, e.g. responsive to the determined coordinate values of other electronic toy modules and/or responsive to changes in the detected coordinate values. In some embodiments, the executable instructions implement an adaptive behaviour that adapts based on previous uses, e.g. using artificial intelligence. In some embodiments, the electronic toy modules are controllable by one or more control toy modules that are communicatively coupled to the electronic toy module.

In some embodiments, the behaviour of the electronic toy modules may be programmed or configured by the user, e.g. by receiving program data and/or configuration parameters. To this end, the electronic toy module may receive program and/or control data and/or configuration parameters from a computer or from another external electronic device, e.g. directly or via another toy module of the system. An external electronic device may e.g. a desktop computer, a tablet computer, a smartphone, a laptop computer, or another programmable computing device. Other examples of external electronic devices include RFID tags or other data storage devices. For example, one or more of the electronic toy modules may be operable to read out such data storage device in a contactless manner.

Some or all of the electronic toy modules may be configured to form a network of communicating nodes. In some embodiments, electronic toy modules formed as one or more toy construction elements may detect each other as being interconnected with each other in a common toy construction model, e.g. by detecting changes in the detected coordinate values as described herein. Once detected as being part of the same toy construction model, the electronic toy modules may be operable to selectively communicate with each other so as to coordinate control of their respective function devices. This may be useful for allowing the electronic toy modules of a model to provide a desired coherent model behaviour. For example, when the model is a vehicle having multiple electronic toy modules comprising respective motors, each driving a respective wheel of the vehicle, the electronic toy modules may determine the relative positions and orientations of the motors and thus ensure coordinated operation of the motors so as to propel the vehicle. Consequently, the electronic toy modules of a toy construction model may be controlled to allow the model to exhibit a relatively complex behaviour without requiring the user to have advanced technical or programming skills.

In some embodiments, the electronic toy modules are operable to implement a learning mode in which they are operable to infer one or more intended functions from their detected relative positions and orientations, optionally in combination with other sensor inputs. During such a learning mode, the electronic toy modules may, based on received sensor signals, detect user-interaction with the toy construction model, e.g. light shown onto the model, sounds, motion/forces imparted on the model and/or the like. The electronic toy modules may then infer corresponding actions, e.g. the output of light and/or sound and/or the activation of one or more motors responsive to the received sensor data. For example, the electronic toy modules may be configured to mirror or match the physical interaction, e.g. by mirroring a detected rhythm or frequency of a clapping sound or blinking light, by activating a motor in response to a pushing force, and/or the like.

Hence, a simple way of adding functionality to a modular toy system or toy construction model, and of controlling such functionality, is provided. One or more electronic toy modules in the form of one or more electronic toy construction elements may simply be added to, or used in, the system or model.

In some embodiments, the electronic toy module may itself be modular, e.g. constructed from two or more toy construction elements. For example, the function device may be accommodated within a function toy construction element and the sensor system may be accommodated within a control toy construction element, optionally together with a control circuit and a power source. When the control toy construction element is electrically, inductively or otherwise operationally coupled to the function toy construction element, they together form an electronic toy construction element as described herein.

DETAILED DESCRIPTION

Various aspects and embodiments of a modular toy system comprising a plurality of electronic toy modules will now be described with reference to toy construction elements in the form of bricks. In these particular and corresponding embodiments, the electronic toy modules are each formed as one or more electronic toy construction elements which each have a housing that is generally shaped as an orthogonal polyhedron with flat side faces and having coupling members extending from its upper surface and a cavity extending into its bottom surfaces. However, other shapes and sizes of electronic toy construction elements may be used, e.g. box-shaped or tile-shaped toy construction elements of different dimensions and with different numbers of coupling members. Moreover, while the brick-shape has proven to be particularly useful, the invention may be applied to other forms of toy construction elements for use in play applications, educational applications and/or the like.

Figure 1:
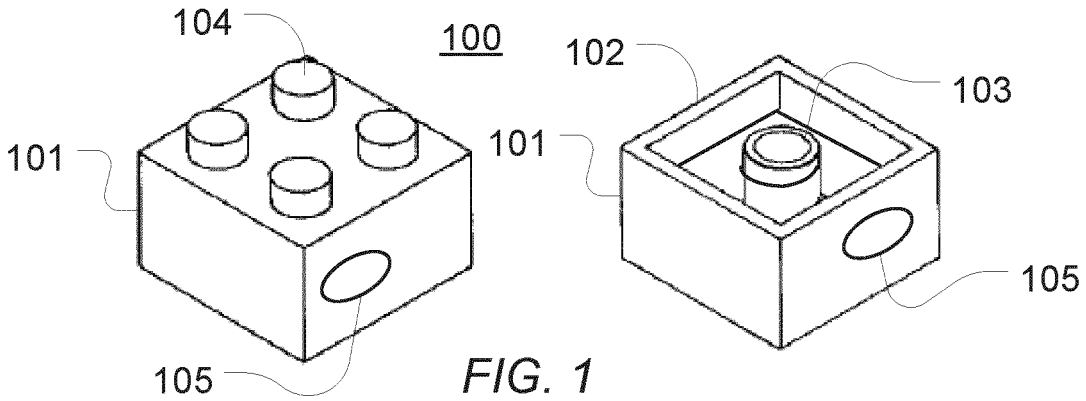
FIG. 1 shows an example of an electronic toy module in the form of an electronic toy construction element.

FIG. 1 shows an example of an electronic toy module in the form of an electronic toy construction element, generally designated 100. In particular, the electronic toy construction element comprises a generally box-shaped housing 101 with coupling pegs 104 extending from its top surface and with a cavity extending into the element from the bottom. The cavity is defined by side walls 102 and by a central, downwardly extending tube 103. The coupling pegs of another toy construction element can be received in the cavity in a frictional engagement as disclosed in U.S. Pat. No. 3,005,282. The construction elements shown in the remaining figures have this known type of coupling members in the form of cooperating pegs and cavities. However, other types of coupling members may also be used in addition to or instead of the pegs and cavities. The coupling pegs are arranged across the top surface in a square planar grid, i.e. defining orthogonal directions along which sequences of coupling pegs are arranged. The distance between neighbouring coupling pegs is uniform and equal in both directions. This or similar arrangements of coupling members at coupling locations defining a regular planar grid allow the toy construction elements to be interconnected in a discrete number of positions and orientations relative two each other, in particular at right angles with respect to each other. In a constructed model, the coupling members of multiple toy construction elements may thus be located on grid points of a three-dimensional grid defined relative to the toy construction model.

In some embodiments, the toy construction elements are made from plastics material, e.g. thermoplastic polymers, or from another suitable material. The toy construction elements may e.g. be made by an injection molding process or by another suitable manufacturing process.

The electronic toy construction element 100 comprises a function device in the form of a loudspeaker 105 or other sound source accommodated within the housing 101 of the electronic toy construction element. It will be appreciated that other examples of electronic toy construction elements may comprise another type of function device (e.g. a light source, a motor, etc.). Some embodiments of the electronic toy construction element may, alternative to or in addition to the function device, comprise a sensor, such as a sound sensor, a light sensor, etc. It will further be appreciated that other embodiments of toy construction systems may include electronic toy construction elements of different shapes or sizes, e.g. so as to accommodate the specific sensors of function devices and/or in order to make them more easily distinguishable by the user.

Figure 2:
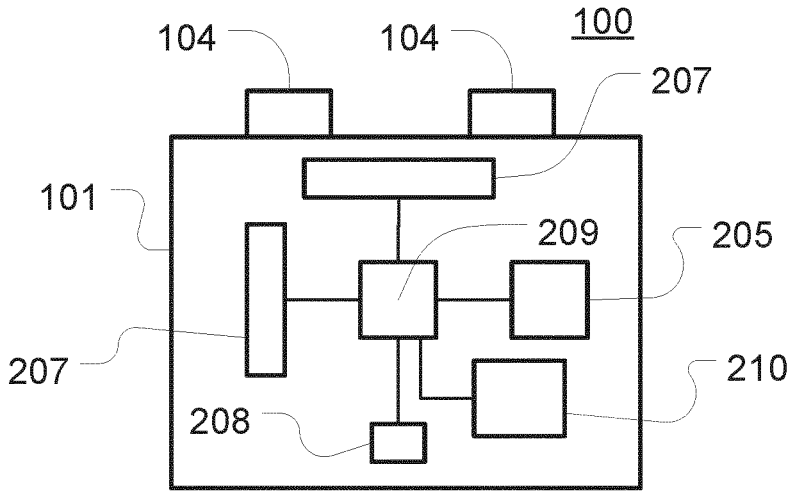
FIG. 2 shows a block diagram of an example of an electronic toy module in the form of an electronic toy construction element.

FIG. 2 shows a schematic block diagram of an example of an electronic toy module formed as an electronic toy construction element, generally designated 100, e.g. of the electronic toy construction element shown in FIG. 1.

The electronic toy construction element comprises a housing 101. In this example, the housing defines a top face that is provided with coupling members 104 as described above; it will be appreciated that other embodiments may include other types of housing. The electronic toy construction element further comprises, accommodated within housing 101, a control circuit 209, two electromagnetic coils 207, a magnetometer 208, a function device 205 and a rechargeable battery 210.

Each electromagnetic coil defines a coil axis around which the coil extends. The electromagnetic coils 207 are arranged with their coil axes being arranged orthogonal to each other. In particular, the electromagnetic coils 207 are arranged such that one coil is arranged with its coil axis parallel with the top face of the housing while the other coil is arranged with its coil axis parallel to one of the side faxes of the housing. In this manner, the electromagnetic coils can harvest energy in different orientations of the housing relative to an external electromagnetic field. Also, the electromagnetic coils may detect position and/or orientation coordinates of another, similar electronic toy construction element having similar arrangements of electromagnetic coils. It will be appreciated, however, that other arrangements are possible.

The electronic toy construction element may receive electrical energy via the electromagnetic coils 207 for charging the battery 210, which in turn powers the control circuit 209 and the function device 205.

The function device 205 may be a light source, e.g. an LED, a loudspeaker, a motor, and or another function device operable to perform a user-perceivable function.

The control circuit 209 may comprise one or more microcontrollers, one or more microprocessors, and/or one or more other suitable processing units, or combinations thereof.

The magnetometer 208 may be arranged to measure the strength of an external magnetic field, in particular of a static magnetic field, e.g. the geomagnetic field, along at least one direction, e.g. a direction across the plane defined by the coil axes of the electromagnetic coils, e.g. orthogonal to that plane. The magnetometer may be embedded on the same chip as the control circuit 209. In particular, the magnetometer may be arranged to only measure the strength of an external magnetic field along a single direction.

The electronic toy construction element may comprise additional components, e.g. a communications circuit that may be operable for two-way communication with other electronic toy construction elements and/or with other processing devices. Accordingly, the electronic toy construction element may be operable to communicate its identity and/or operational characteristics, e.g. by communicating a unique identifier and/or an identifier identifying a type of electronic toy construction element, e.g. whether it comprises a motor, light source, loudspeaker etc. Moreover, in some embodiments, the electronic toy construction element may communicate a sensor signal representing a quantity sensed by a sensor of the electronic toy construction element or an operational parameter of the electronic toy construction model, e.g. an excitation strength of the coils.

In some embodiments, the electronic toy construction element includes a light sensor, a sound sensor, a rotational encoder, an accelerometer, a gyro, and/or any other suitable sensor.

The electromagnetic coils and/or the magnetometer are operable to detect the orientation of the electronic toy construction element relative to the geomagnetic field. In one embodiment, the magnetometer is operable to detect the strength of the geomagnetic field along a single direction or along two or even three directions. This in turn may serve as an indication of the orientation of the electronic toy construction element relative to a reference frame. Moreover, the electronic toy construction element may be configured to energize the electromagnetic coils and/or to measure the strength and/or direction of a magnetic field generated or modified by corresponding coils of another electronic toy construction element. In this manner, based on measurements by the electromagnetic coils and the magnetometer, the electronic toy construction element may detect a distance to and a relative orientation of another electronic toy construction element. Moreover, by monitoring the distance and/or relative orientation over time, the electronic toy construction element may detect whether the electronic toy construction elements move or are stationary relative to each other. In this manner, the electronic toy construction element may determine which other electronic toy construction elements are mutually interconnected within a coherent toy construction model.

Figure 3:
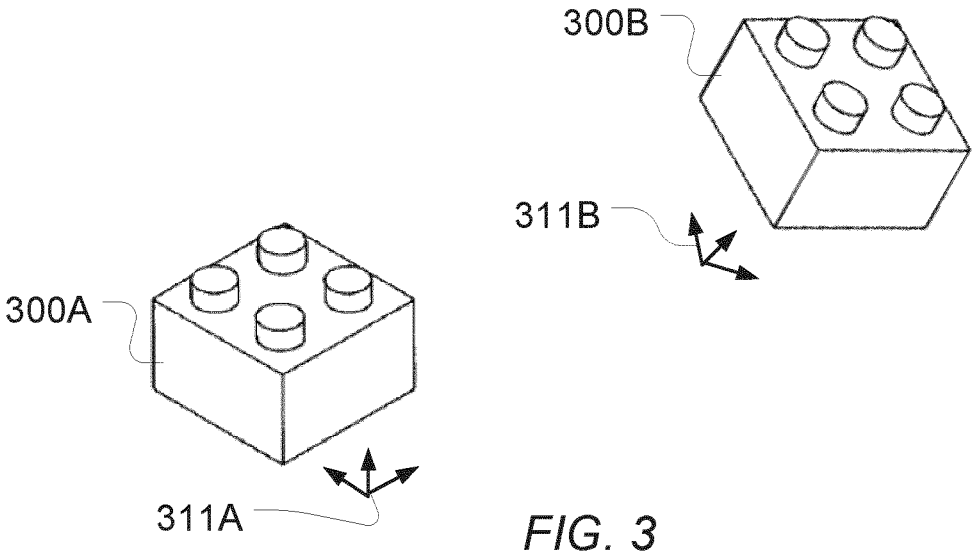
FIG. 3 illustrates operation of an example of electronic toy construction elements.

FIG. 3 illustrates two electronic toy modules 300A and 300B, respectively, of the type shown in FIG. 2. The electronic toy modules 300A and 300B may include the same type of function device or different types of function devices. The electronic toy module 300A is operable to detect the distance between the electronic toy module 300B and the electronic toy module 300A and the relative orientation between them, e.g. as three angles defining the rotation of an internal coordinate system 311B of the electronic toy module 300B relative to an internal coordinate system 311A of the electronic toy module 300A. The angles may thus describe a pitch, yaw and roll, respectively, of the module 300B relative to the module 300A. Similarly, electronic toy module 300B may detect the corresponding distance and relative orientation of module 300A. When the electronic toy modules are operable to communicate with each other, they may further exchange information about their identity and/or the type of function device they include and/or about their respective operational states, etc. For example, the electronic toy modules may exchange information about the measured strengths of a geomagnetic field measured by their respective magnetometers. Alternatively or additionally, they may exchange information about the excitation strength of their respective coils. It will be appreciated that, if the excitation strength is predefined or otherwise known a priori, this information may not need to be communicated.

Accordingly, toy module 300A may know the measured strength of the geomagnetic filed measured by the magnetometer of toy module 300B and toy module 300A may further know the excitation strengths of the coils of toy module 300B. The toy module 300A may measure the magnetic field sensed by each of the coils of toy module 300A and toy module 300A may measure the strength of the geomagnetic field by its magnetometer.

As the measured magnetic field by the coils of toy module 300A depend on the relative orientation and distance between the toy modules, and as the measured geomagnetic field measured by each toy module depends on their respective orientation relative to the geomagnetic field, toy module 300A may determine the relative orientation and distance between the toy modules 300A and 300B based on its own measurements (by the coils and the magnetometer of toy module 300A), based on the received (or otherwise known) information about the excitation strengths of the coils of toy module 300B and based on the received information about the measured strength of the geomagnetic field as measured by toy module 300B.

Generally, the inventors have realised that the a toy module can compute the distance to another toy module and the relative orientation (pitch, yaw and role) between two toy modules using two readings from two electromagnetic coils and from a single direction of geomagnetic sensing. To this end each toy module comprises two electromagnetic coils which may also be used for short-range communication that can be built into the ASIC of the toy module as a single plane Hall effect sensor.

It will be appreciated that other sensor configurations or sets of data may be used. For example, when each toy module includes three coils oriented along three different directions, the measurements of each coil of one toy module and the knowledge of excitation strengths of the coils of the other toy module may be sufficient to compute the distance and relative orientation between the toy modules.

Based on their relative distance and orientation, the electronic toy module 300A may determine whether it is physically connected to electronic toy module 300B, e.g. as part of the same coherent toy construction model—or at least whether it is likely to be thus interconnected. To this end, the electronic toy module may determine whether the measured distance and orientation is consistent with the limitations imposed by the toy construction system. Alternatively or additionally, the electronic toy module may monitor the relative distance and/or relative orientation over a period of time. If the distance and/or relative orientation remains constant, the electronic toy module may determine that the elements are indeed interconnected.

In particular, the electronic toy module 300A may monitor the distance and/or relative orientation during a period where it detects changes of its own orientation relative to the geomagnetic field. If the distance and/or relative orientation between the modules 300A and 300B remain unchanged during such detected change of the geomagnetic field, each of the modules may determine that it is physically interconnected with the respective other module.

Figure 4:
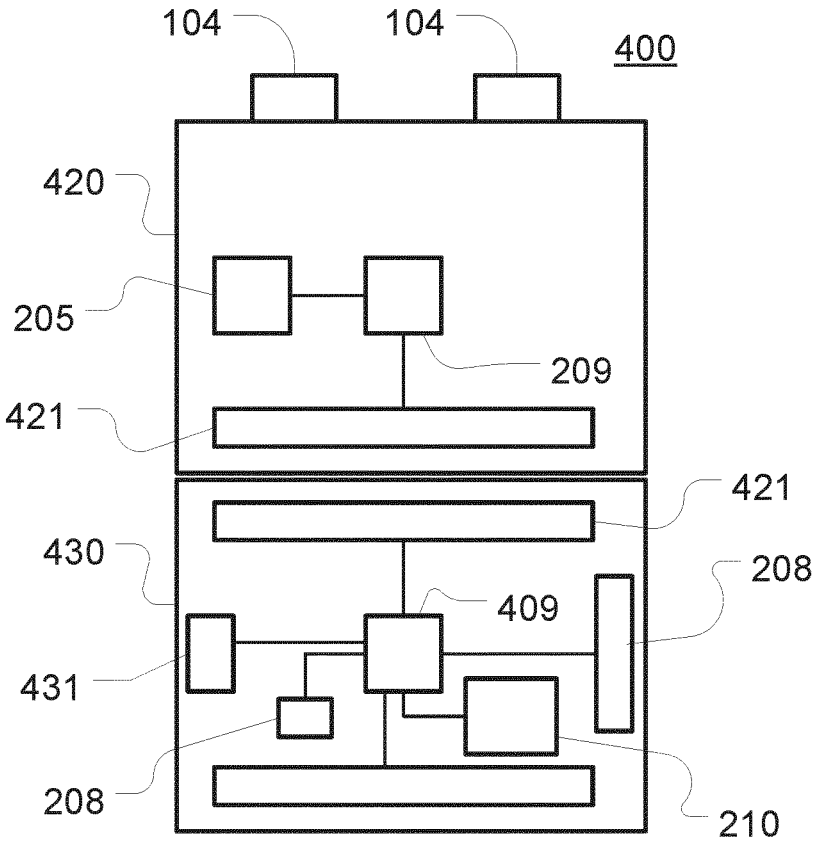
FIG. 4 shows a block diagram of another example of an electronic toy module formed by two electronic toy construction elements.

FIG. 4 illustrates another example of an electronic toy module, generally designated by reference numeral 400. In this example, the electronic toy module 400 is itself constructed from two individual electronic toy construction elements, namely from a function toy construction element 420 and a control toy construction element 430, respectively. Each of the function toy construction element and the control toy construction element comprises a housing having coupling members, e.g. as described in connection with the electronic toy construction element of FIG. 1. The function toy construction element 420 is stacked on top of the control toy construction element 430 such that the two elements are interconnected by their respective coupling members.

The function toy construction element 420 and the control toy construction element 430 each comprises a respective interface 421 for transferring energy and/or control signals from the control toy construction element to the function toy construction element. The interface 421 may be an interface relying on a conductive contact or it may be a contactless, e.g. inductive interface.

The function toy construction element further comprises a function device 205 and, optionally its own control circuit 209, e.g. as described in connection with the electronic toy construction element of FIG. 2.

The control toy construction element comprises, accommodated inside its housing, a control circuit 409, electromagnetic coils 207, a magnetometer 208 and a rechargeable battery 210, all as described in connection with the respective components of the electronic toy construction element of FIG. 2.

Hence, the control toy construction element and the function toy construction element together are operable to perform the same functions as the electronic toy module of FIG. 2 and they include the same components for performing these functions. However, the components are distributed between two physically separable toy construction elements.

The control toy construction element further comprises a wireless communications circuit 431. The communications circuit 431 may e.g. comprise a communications transceiver, or the like, and an antenna operable for short-range radio-frequency communication with other control toy construction elements and/or with other electronic toy construction elements and/or with one or more other electronic devices. The short-range radio-frequency communication may be implemented using the Bluetooth technology or another suitable communications technology such as Wifi.

The control circuit 409 is configured, e.g. by a suitable program executed on a microprocessor, to control the various components of the control toy construction element as well as the function device 205. In particular, the control circuit 409 may perform the detection of distances and orientations of other electronic toy construction elements within a detection range of the element 430.

Figure 5:
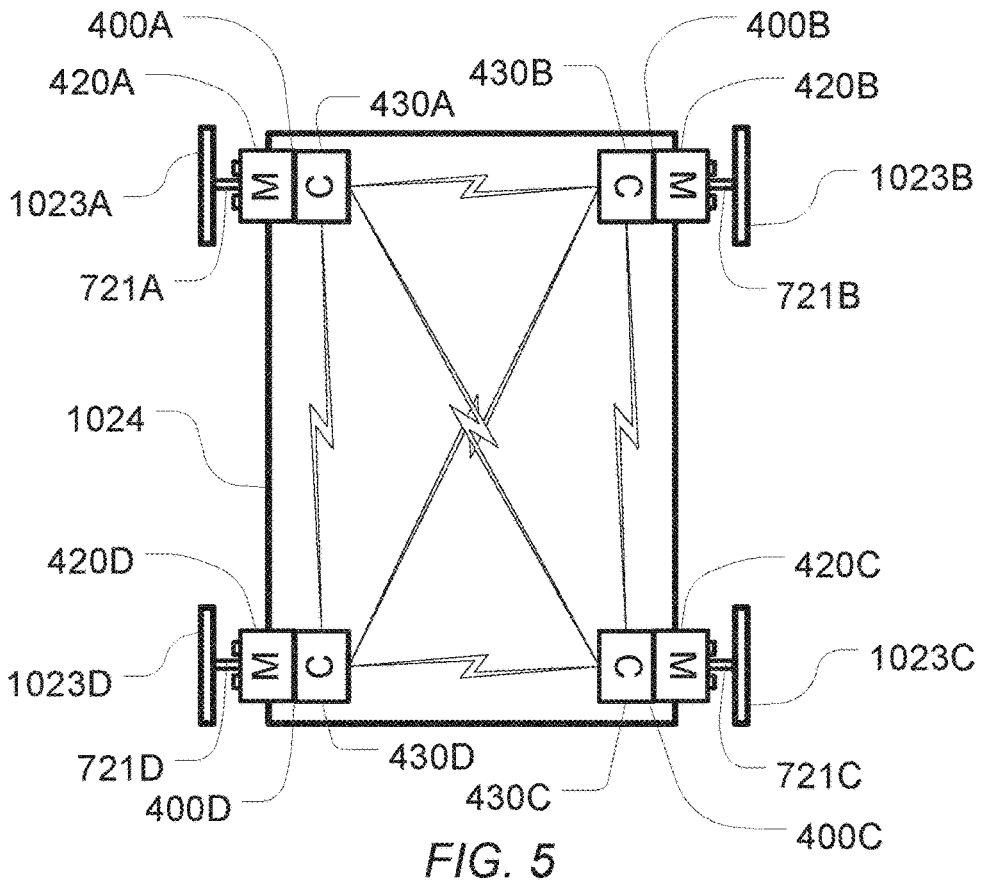
FIG. 5 schematically shows an example of a toy construction model constructed from toy construction elements as described herein.
Figure 6:
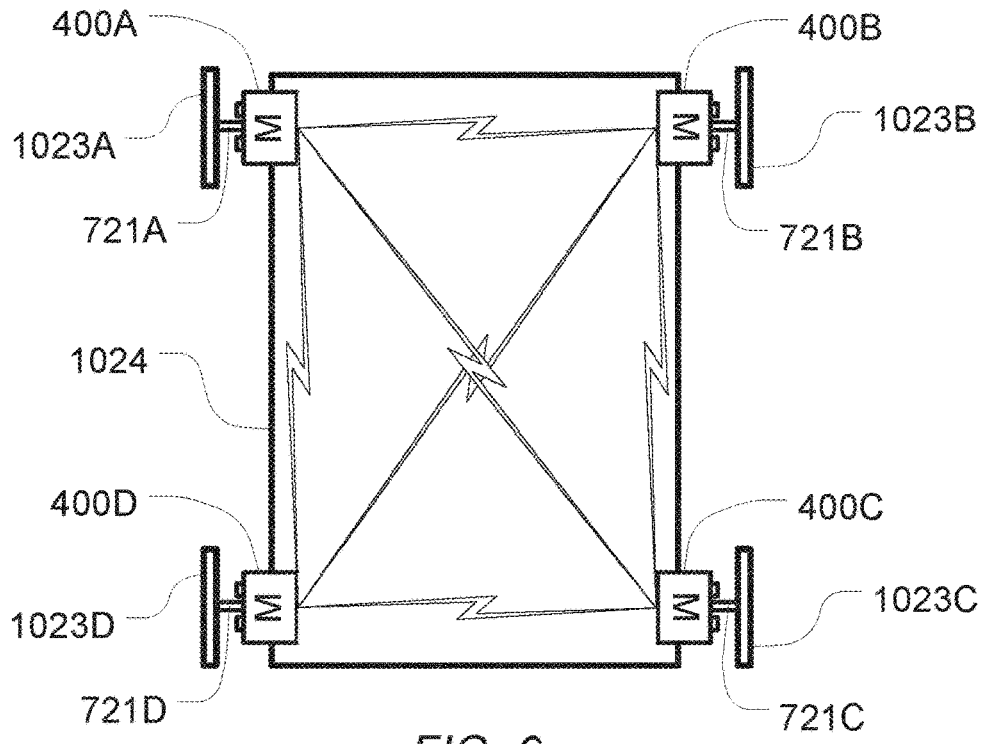
FIG. 6 schematically shows another example of a toy construction model constructed from toy construction elements as described herein.

FIGS. 5-6 illustrate examples of toy construction models constructed from a toy construction system as described herein. In particular, the toy construction models include a plurality of electronic toy modules, e.g. as described in connection with FIG. 2 or 4. While not necessarily explicitly shown in FIGS. 5-6 for ease of illustration, it will be appreciated that examples of toy construction models may include further toy construction elements, including toy construction elements other than electronic toy construction elements.

FIG. 5 schematically shows an example of a toy construction model constructed from toy construction elements as described herein. In the example of FIG. 5, the toy construction model 1024 is a vehicle, such as a car, but it will of course be appreciated that toy construction models representing other items may be constructed. The toy construction model 1024 is constructed from a plurality of conventional toy construction elements and from a number of electronic toy modules 400A-D. In the example of FIG. 5, the electronic toy modules are of the type described in connection with FIG. 4, i.e. they each comprise a function toy construction element 420A-D, respectively, and a control toy construction element 430A-D, respectively. Each function toy construction element is inductively coupled (directly or indirectly) with one of the control toy construction elements. In the specific example of FIG. 10, the toy construction model comprises four control toy construction elements 430A-D, respectively, each physically connected and inductively coupled to a respective function toy construction element 420A-D, e.g. as described in connection with FIG. 4. Each of the function toy construction elements 420A-D comprises a motor for driving a shaft 721A-D, respectively, that is inserted into a hole of the electronic toy construction element. Each shaft is attached to a corresponding wheel 1023A-D, respectively, such that each electronic toy construction element is operable to drive a corresponding one of the wheels.

The control toy construction elements are spaced apart from each other within the model and are not inductively coupled with each other. Nevertheless, they may wirelessly communicate with each other via their respective wireless communications interfaces by short-range wireless communication. This may allow for a coordinated control of the respective motors. For example, one of the control toy construction elements may operate as a master that sends control signals to the other control toy construction elements, the control signals including e.g. on/off signals, speed and/or direction signals. Alternatively, each control toy construction element may operate autonomously. For example, each control toy construction element may control the motor of the function toy construction element inductively coupled to it responsive to sensor signals from an encoder included in the electronic toy construction element inductively coupled to the control toy construction element. In particular, in one example, when the encoder detects that the wheel is turned due to an external torque (e.g. because the user pushes the vehicle across a surface), the control toy construction element may control the motor in the same direction as the detected rotation, e.g. for a predetermined period of time or for a time dependent on the detected duration during which the wheel has been turned.

In order to coordinate operation of the motors, the control construction elements may detect the relative orientations of the other toy construction elements as described herein.

FIG. 6 schematically shows another example of a toy construction model constructed from toy construction elements as described herein. The example of FIG. 6 is similar to the example of FIG. 5 except that each of the electronic toy construction modules 400A-D is formed as a single electronic toy construction element, e.g. as in the example of FIG. 2.

Figure 7:
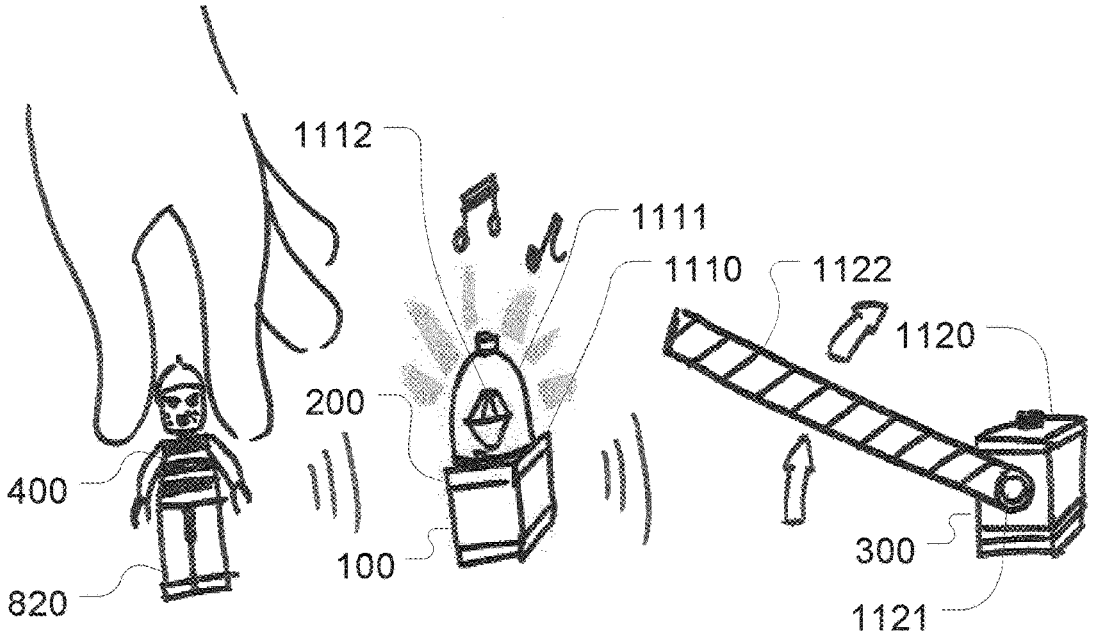
FIGS. 7-10 illustrate examples of uses of a toy construction system as described herein.

FIG. 7 illustrates an example of a use of a toy construction system as described herein. In particular, FIG. 7 illustrates a toy construction set comprising toy construction elements from which toy construction models 820, 1110 and 1120 have been constructed. In particular, the toy construction set comprises electronic toy construction modules in the form of electronic toy construction elements 100, 200, 300 and 400. Electronic toy construction element 100 is an electronic toy construction element as described in connection with FIGS. 1 and 2; it includes a function device in the form of a loudspeaker. Electronic toy construction element 200 is an electronic toy construction element as described in connection with FIG. 2; it includes a function device in the form of an LED light source. Electronic toy construction element 300 is an electronic toy construction element as described in connection with FIG. 2 with a function device in the form of a motor for driving a shaft 1121 insertable into a hole of the housing of the electronic toy construction element 300. Electronic toy construction element 400 has the shape of a torso of a figurine.

The toy construction model 820 is in the form of a figurine or doll. In particular, it includes electronic toy construction element 400 which includes a wireless communications circuit operable to communicate with corresponding wireless communications circuits of the electronic toy construction elements 100-300. Moreover, each of the electronic toy construction elements 100-400 includes a respective sensor system for detecting their relative distances and orientations with relative to each other. In particular, each of the electronic toy construction elements may comprise two electromagnetic coils and a magnetometer as described in connection with FIG. 2.

Toy construction model 1110 comprises electronic toy construction elements 100 and 200 as well as additional, non-electronic toy construction elements, such as conventional toy construction elements. In this specific example, the additional toy construction elements include a transparent, dome-shaped cover 1111 that is attachable to electronic toy construction element 200 so as to create a void for accommodating another toy construction element 1112. Hence, light emitted by the light source of electronic toy construction element 200 illuminates toy construction element 1112 and provides a visible effect, observable by the user through the transparent dome-shaped cover.

Toy construction model 1120 comprises electronic toy construction element 300 as well as additional, non-electronic toy construction elements, such as conventional toy construction elements. In this specific example, the additional toy construction elements include a shaft 1121 inserted into the hole of electronic toy construction element 300, and an elongated bar 1122 attached to shaft 1121 such that the bar is pivotable between a lowered position and a raised position.

Electronic toy construction element 200 may be configured to detect the presence of electronic toy construction element 400 and detect its distance from and relative orientation relative toy construction element 200. Electronic toy construction element may thus detect movements of the figurine relative to the model 1110. Responsive to such detection, the electronic toy construction element 200 may control its light source to emit light. Similarly, electronic toy construction element 100 may emit a sound, e.g. simulating a siren, when it detects that the figurine 820 is approaching. In some embodiments, an attribute of the light (e.g. a blinking frequency, a color, an intensity, etc.) and/or an attribute of the sound (e.g. a volume, a pitch, etc.) may be controlled by the respective electronic toy construction element responsive to aspects of the movement, e.g. the speed of movement, whether the figurine moves towards or away from model 1110, the type of detected electronic toy construction element 400, an estimated distance to the figurine 820 and/or the like.

Electronic toy construction element 100 and/or 200 may further communicate with electronic toy construction element 300 via their respective wireless short-range communications circuits. For example, electronic toy construction element 100 and/or 200 may communicate information about the detected figurine 820 to electronic toy construction element 300. Responsive to the received information, electronic toy construction element 300 may the motor so as to raise or lower bar 1122. Alternatively or additionally, electronic toy construction element 300 may be triggered to control operation of its motor in a different manner. For example, electronic toy construction element may itself detect the presence of figurine 820.

Accordingly, the above example illustrates that relatively involved game scenarios may be implemented with only a few relatively inexpensive electronic toy construction elements described herein.

In the following, various examples of other play scenarios that can be implemented with embodiments of a toy construction system described herein will be described.

Figure 8:
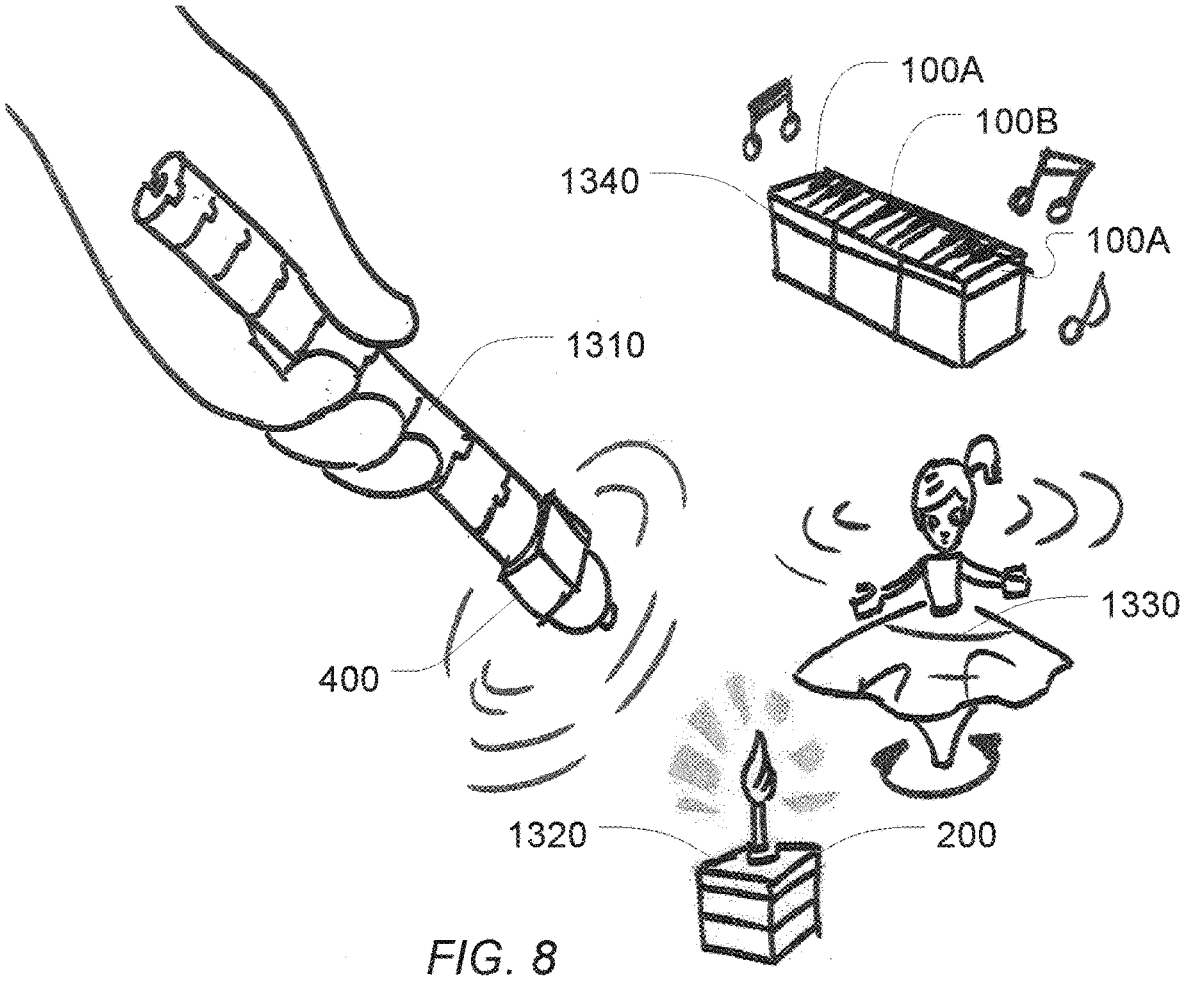

FIG. 8 illustrates another example of a toy construction set. The toy construction set of FIG. 8 includes toy construction models 1310-1340 each including one or more electronic toy modules in the form of electronic construction elements. In particular, toy construction model 1310 is an elongated wand constructed from multiple conventional toy construction elements and from electronic toy construction element 400.

Toy construction model 1320 includes an electronic toy construction element 200 that includes a light source.

Toy construction model 1330 resembles a figurine and includes an electronic toy construction element (not explicitly visible in FIG. 8) which includes a motor for effecting rotation of the figurine.

Toy construction model 1340 resembles a musical instrument and includes electronic toy construction elements 100A-C, each including a loudspeaker.

When the user moves the wand 1310, the motion is detected by the electronic toy construction elements 200, 100-A-C of the other toy construction models.

Responsive to the detected motion, the electronic toy construction elements of toy construction models 1320-1340 may control their respective function devices to perform their various functions, e.g. to cause the figurine 1330 to turn, the light of electronic toy construction element 200 to emit light and/or the electronic toy construction elements 100A-C to play a musical tune.

Figure 9:
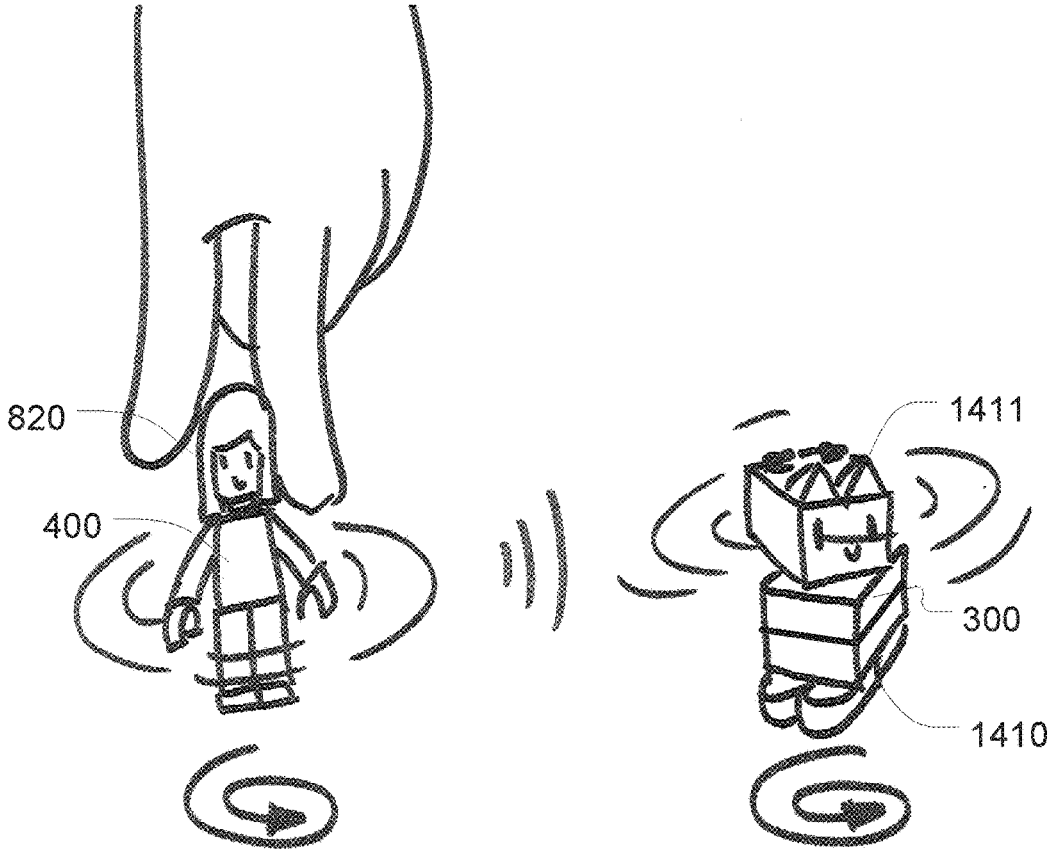

FIG. 9 illustrates yet another example of a toy construction set. The toy construction set of FIG. 9 includes a figurine 820 as described in connection with FIG. 7 and a toy construction model 1410. The toy construction model 1410 comprises an electronic toy construction element 300 including a motor. Electronic toy construction element 300 is configured to rotate a rotatable part 1411 of toy construction model 1410 that is shaped as a head of an animal or other creature.

Figurine 820 includes an electronic toy construction element 400 as described above. Electronic toy construction element 300 is configured to detect a user-induced motion of the figurine 820. Responsive to the detected motion, electronic toy construction element 300 operates its motor so as to mimic the detected movement by the rotatable head 1411.

Accordingly, similar to the example of FIG. 8, the figurine may thus be operable as a wand or controller operable to control a function of toy construction model 1410.

Figure 10:
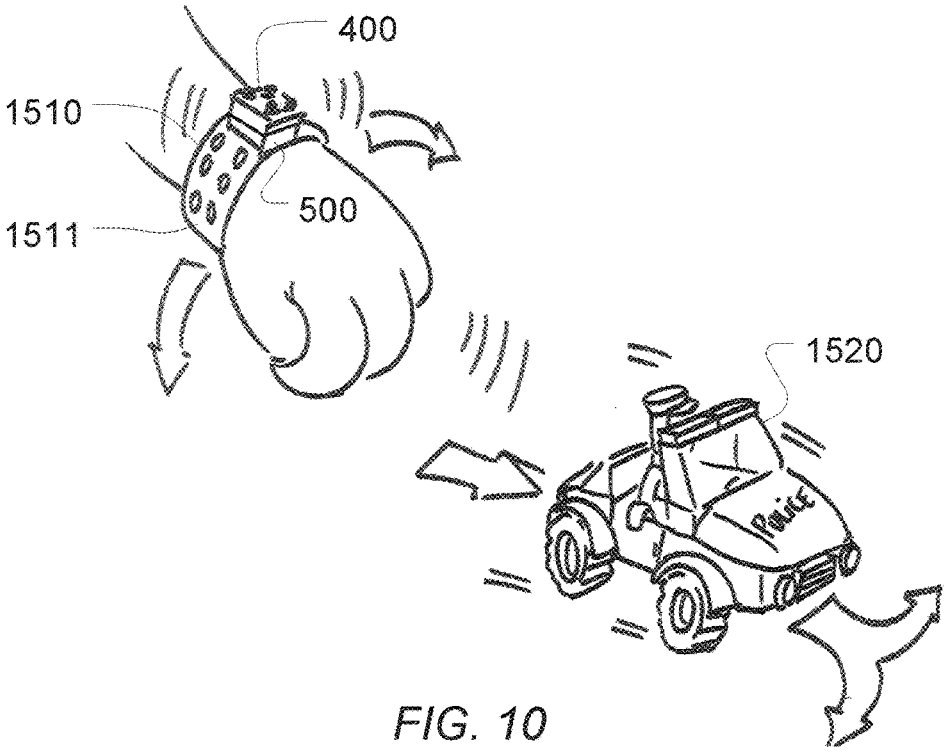

FIG. 10 illustrates yet another example of a toy construction set. The toy construction set of FIG. 10 includes toy construction models 1510 and 1520 each including one or more electronic toy construction elements. In particular, toy construction model 1310 is a wearable toy construction model. It includes a wearable component, such as a wristband 1511, which comprises coupling members to which other toy construction elements can be attached. In the present example, toy construction model 1510 includes an electronic toy construction element 400 that includes a sensor system as described herein.

Toy construction element 1520 resembles a car. It includes one or more electronic toy construction elements (not explicitly shown) for driving one or more wheels of the car, e.g. as described in connection with FIGS. 5 and 6. The toy construction model 1520 further comprises an electronic toy construction element (not explicitly shown) for actuating a steering mechanism of the car.

The electronic toy construction elements of the car are operable to detect movements of the electronic toy construction element 400 of wearable toy construction model 1510 and thus movements of the user's hand when the wearable component is worn around the wrist of the user. The electronic toy construction elements of the car 1520 may then control the wheels and steering mechanism responsive to the detective movements, e.g. so as to propel and steer the car.

Embodiments of the control circuits of the electronic toy construction elements described herein can be implemented by means of hardware comprising several distinct elements, and/or at least in part by means of a suitably programmed microprocessor.

In the claims enumerating several means, several of these means can be embodied by one and the same element, component or item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, elements, steps or components but does not preclude the presence or addition of one or more other features, elements, steps, components or groups thereof.

The invention claimed is:

1. A modular toy system comprising a plurality of separate electronic toy modules, each electronic toy module comprising:

a function device adapted to perform a user-perceptible function; and a control circuit for controlling the function device, wherein at least a first electronic toy module of the plurality of electronic toy modules comprises:

a first control circuit, a first function device adapted to perform a user-perceptible function, and a sensor system configured for contactless detection of respective coordinate values of at least two coordinates, each coordinate being indicative of a position or an orientation of at least a second electronic toy module of the plurality of electronic toy modules relative to the first electronic toy module;

wherein the first control circuit is configured to control operation of the first function device to perform a user-perceptible function based on one or more of the detected coordinate values;

wherein the sensor system comprises at least two electromagnetic coils each configured to sense a time-varying magnetic field;

wherein each electromagnetic coil defines a coil axis and wherein the coil axes of the at least two coils define an angle between the coil axes, the angle being larger than zero degrees; and wherein the electronic toy module is configured to measure the strength and/or direction of a magnetic field generated or modified by corresponding coils of another electronic toy module.

2. The modular toy system according to claim 1, wherein the first electronic toy module is configured to harvest energy for operating the first function device from an electromagnetic field via at least one of the one or more electromagnetic coils.

3. The modular toy system according to claim 1, wherein the sensor system comprises three electromagnetic coils.

4. The modular toy system according to claim 1, wherein the sensor system comprises one or more magnetometers.

5. The modular toy system according to claim 4, wherein the sensor system consists of two electromagnetic coils and a single magnetometer.

6. The modular toy system according to claim 1, wherein the sensor system is further configured to detect an orientation of the first electronic toy module relative to a geomagnetic field.

7. The modular toy system according to claim 1, wherein the second electronic toy module comprises a sensor system configured for contactless detection of respective coordinate values of at least two coordinates, each coordinate being indicative of a position or an orientation of at least the first electronic toy module relative to the second electronic toy module.

8. The modular toy system according to claim 1, wherein the at least two coordinates comprise a distance between the second electronic toy module and the first electronic toy module.

9. The modular toy system according to claim 1, wherein the sensor system is configured to detect three independent orientation coordinates.

10. The modular toy system according to claim 1, wherein the electronic toy modules are mechanically interconnectable with each other so as to form a toy assembly;

wherein the sensor system is configured to monitor a coordinate value of at least one of the coordinates; and wherein the modular toy system comprises a processor configured to determine, based on the monitored coordinate value, whether or not the first and second electronic toy modules are mechanically interconnected.

11. The modular toy system according to claim 10, wherein the processor is configured to detect, based at least on the monitored coordinate value, a physical topology of said set of electronic toy modules in said toy assembly.

12. A toy system comprising:

a first and second electronic toy construction element each having:

two electromagnetic coils arranged configured to emit a magnetic field;

a magnetometer configured to sense a magnetic field of another electronic toy construction element, the magnetometer further configured to detect position and/or orientation coordinates of the other electronic toy construction element based on the sensing of the magnetic field;

a function device adapted to perform a user-perceptible function; and a control circuit configured to control operation of the function device to perform the user-perceptible function based on the detected position and/or orientation coordinates of the other electronic toy construction element.

13. The toy system of claim 12, wherein the two electromagnetic coils of each toy construction element are arranged orthogonal relative to each other.

14. The toy system of claim 12, wherein the magnetometer is configured to determine if the first and second electronic toy construction elements are physically connected based on the detected position and/or orientation coordinates of the other electronic toy construction element.

15. A toy system comprising:

a plurality of electronic toy modules, each electronic toy module comprising:

a function device adapted to perform a user-perceptible function; and a control circuit for controlling the function device, wherein at least a first electronic toy module of the plurality of electronic toy modules comprises:

a first control circuit configured to control operation of the function device of the first electronic toy module to perform a user-perceptible function based on one or more of the detected coordinate values, a first function device adapted to perform a user-perceptible function, and a magnetometer and two electromagnetic coils configured for contactless detection of coordinate values indicative of a position or an orientation of at least a second electronic toy module of the plurality of electronic toy modules relative to the first electronic toy module, wherein:

the detection is based on a time-varying magnetic field of the second electronic toy module, each electromagnetic coil defines a coil axis, the coil axes of the two electromagnetic coils defining an angle therebetween greater than zero degrees, and the magnetometer and two electromagnetic coils are configured to measure the strength and/or direction of a magnetic field generated or modified by corresponding coils of another electronic toy module.

16. The toy system of claim 15, wherein the two electromagnetic coils of each toy construction element are arranged orthogonal relative to each other.

17. The toy system of claim 15, wherein the magnetometer is configured to determine if the first and second electronic toy construction elements are physically connected based on the detected coordinate values.

* * * * *